US007586052B2

(12) United States Patent
Adunka et al.

(10) Patent No.: US 7,586,052 B2
(45) Date of Patent: Sep. 8, 2009

(54) ELECTROMECHANICAL SWITCHING DEVICE

(75) Inventors: Robert Adunka, Sulzbach-Rosenberg (DE); Berthold Heldmann, Freudenberg (DE)

(73) Assignee: Siemens Aktiengesellschaft, Munich (DE)

( * ) Notice: Subject to any disclaimer, the term of this patent is extended or adjusted under 35 U.S.C. 154(b) by 178 days.

(21) Appl. No.: 11/885,565

(22) PCT Filed: Mar. 6, 2006

(86) PCT No.: PCT/EP2006/060479

§ 371 (c)(1),
(2), (4) Date: Sep. 4, 2007

(87) PCT Pub. No.: WO2006/094959

PCT Pub. Date: Sep. 14, 2006

(65) Prior Publication Data

US 2008/0164130 A1 Jul. 10, 2008

(30) Foreign Application Priority Data

Mar. 8, 2005 (EP) ..... 05005046

(51) Int. Cl.
*H01H 1/64* (2006.01)

(52) U.S. Cl. ..... 200/293; 200/304; 335/202

(58) Field of Classification Search ..... 200/304, 200/322; 335/202; 439/723–724; 361/614, 361/624, 637

See application file for complete search history.

(56) References Cited

U.S. PATENT DOCUMENTS 5,117,211 A * 5/1992 Morgan et al. ..... 335/202
5,150,091 A * 9/1992 Hart et al. ..... 335/202
5,488,337 A * 1/1996 Hubbard et al. ..... 335/202
5,870,277 A 2/1999 Girard et al.
6,144,001 A * 11/2000 Green et al. ..... 200/304
6,384,350 B1 * 5/2002 Shincovich et al. ..... 200/5 A
6,411,500 B1 6/2002 Kaaden et al.
7,132,913 B2 * 11/2006 Whipple et al. ..... 335/202
7,492,056 B2 * 2/2009 Koutsandreas et al. ..... 307/10.2
2003/0076204 A1 4/2003 Whipple et al.

FOREIGN PATENT DOCUMENTS

DE 195 15 923 11/1996
EP 1 124 286 8/2001
EP 1 447 829 8/2004

* cited by examiner

*Primary Examiner*—Michael A Friedhofer
*Assistant Examiner*—Lisa N Klaus
(74) *Attorney, Agent, or Firm*—Harness, Dickey & Pierce, P.L.C.

(57) ABSTRACT

An electromechanical switching device, a switching device arrangement and an electric connection module are disclosed. In order to make it easier to connect an electromechanical switching device, a switching device is provided with a base body, and with a connection module that can be connected to the base body and has at least one connection terminal for a main current path of the switching device. In at least one embodiment of the present invention, a modular construction is used instead of the integrated design used in previous switching devices. For that purpose, a number of connection terminals are combined into one or more connection modules for each switching device, and the connection modules can be mounted individually and independently from the base body of the switching device. This makes it possible to pre-wire the connection terminals without the actual switching device. Only afterwards does the base body of the switching device need to be mounted.

19 Claims, 13 Drawing Sheets

ELECTROMECHANICAL SWITCHING DEVICE

PRIORITY STATEMENT

This application is the national phase under 35 U.S.C. § 371 of PCT International Application No. PCT/EP2006/060479 which has an International filing date of Mar. 6, 2006, which designated the United States of America and which claims priority on European Patent Application number EP05005046 filed Mar. 8, 2005, the entire contents of which are hereby incorporated herein by reference.

FIELD

At least one embodiment of invention generally relates to an electromechanical mechanical switching device, to a switching device arrangement and/or to an electrical connecting module.

BACKGROUND

In electromechanical switching devices, for example motor circuit breakers, contactors, overload relays and other apparatuses for switching, protection and starting of motors and installations, the connecting terminals for the main current paths are permanently integrated in the switching devices. When a switching device is replaced, it is therefore always necessary to detach the wiring lines to the individual connecting terminals of the switching device. When the switching device is reconnected to the wiring lines, it is therefore possible for wiring faults to occur.

European patent application EP 1 124 286 A1 discloses an electrical conductor being fixed in a terminal strip with the aid of quick-release connections, with the terminal strip being detachably connected to the housing of an electrical device. A system in which a connecting apparatus for an electrical conductor is likewise detachably connected to the device housing is also known from U.S. Pat. No. 6,411,500 B1. The connection of the conductors is admittedly simplified in these solutions. However, it is no longer possible to easily remove the switching device once it has been mounted on a mounting rail.

SUMMARY

At least one embodiment of the present invention therefore simplifies the replacement of an electromechanical switching device once it has been mounted on a mounting rail.

According to at least one embodiment of the invention, an electromechanical switching device is provided which has a switching device base body and a connecting module which can be connected to the switching device base body and has at least one connecting terminal for a main current path of the switching device. One fundamental idea of at least one embodiment of the present invention is to use a modular design instead of the integrated configuration previously used for switching devices. In this case, a number of connecting terminals are combined in one or more connecting modules for each switching device, and can be connected to the switching device base body.

Thus, the connecting module can be installed individually and independently of the switching device base body. This allows prewiring of the connecting terminals, without the actual switching device. There is no need to install the switching device base body, which contains the normal switching device elements, until later.

Furthermore, provision may be made for the mechanical connection of the connecting module and switching device base body to be made with the aid of a locking element. The locking element is in this case designed such that the connection of the connecting module and switching device base body is released when a connection is made between the connecting module and a mounting plate, in order to mount the switching device on a mounting rail.

The connection of the connecting module to the switching device base body is preferably detachable, so that it is possible to replace the switching device base body while the connecting terminals are at the same time completely wired. When maintenance is required, this makes it possible to greatly reduce the required time for the replacement work.

Furthermore, when a replacement is carried out, wiring faults are precluded since the individual wiring lines need not be detached from the connecting terminals.

Since the connecting terminals of the connecting module are connecting terminals for the main circuit, that is to say the main current paths in the switching device, it is particularly advantageous for the electrical connection between the connecting module and the switching device base body to be a plug connection. The high currents flowing in the main circuit as well as the short-circuit currents which occur in the event of a fault can therefore also be transmitted reliably. This embodiment of at least one embodiment of the invention for the first time makes it possible to provide plug-in connecting terminals for the main current paths of a switching device of modular configuration.

The locking element is preferably permanently fitted to the connecting module, so that it is always available during installation work. Furthermore, the fitting of the locking element to the connecting module makes it possible to ensure that the locking element is always in the correct installation position. However, it is of course likewise possible for the locking element to be provided on the switching device base body or else as an individual part, which is inserted between the connecting module and the switching device base body for installation.

It has been found to be particularly advantageous to use a locking element for a safe mechanical connection, which can nevertheless be disconnected again simply, operating in the form of a lever lock, with operation of the lever releasing the connection between the connecting module and the switching device base body. In this case, the locking element is preferably a two-armed lever, having a locking catch on one of its levers which, when in the locked position, rests on a latching projection on the connecting module or on the switching device base body.

In this case, the lever is preferably designed such that the locking catch is pushed out by pushing the lever downwards, in order to change to the open position. The switching device base body according to one further embodiment of the invention is designed for direct mounting on a mounting rail. The mounting rail may, for example, be a so-called top-hat rail, which is used to arrange the switching device in a switchgear cabinet or the like.

In the situation where direct mounting on a mounting rail is not intended, the invention provides a switching device arrangement which, in addition to the switching device, has a mounting plate for mounting the switching device on a mounting rail.

In this case, the mounting plate preferably has a holding plate and a mounting part which is detachably connected to the holding plate, in which case it has been found to be advantageous for handling of the switching device arrangement on the one hand for the mounting part to have connection elements for forming a detachable mechanical connection to the connecting module, and on the other hand for the holding plate to have connection elements for forming a detachable mechanical connection to the switching device base body.

According to one particularly advantageous embodiment of the invention, the connection between the connecting module and the switching device base body is released when the mounting part and the connecting module are connected to one another. In other words, in this case, since there is neither a mechanical nor an electrical connection between the connecting module and the switching device base body any longer, the switching device base body can be removed from the switching device arrangement, without any problems, for example by pulling it out. During this process, the connecting module is still connected to the mounting part of the mounting plate.

In consequence, it remains in the mounting position even when the switching device base body has been "withdrawn". A new switching device base body can be "plugged in" without any problems. The switching device base body can therefore be replaced without any rewiring, and therefore particularly easily and without faults.

In order to release the connection between the connecting module and the switching device base body when the connecting module is connected to the mounting part, the mounting part preferably has an operating element, which operates the locking element between the connecting module and the switching device base body.

BRIEF DESCRIPTION OF THE DRAWINGS

Embodiments of the invention will be explained in more detail in the following text with reference to the drawings, in which.

DETAILED DESCRIPTION OF THE EXAMPLE EMBODIMENTS

Figure 1:
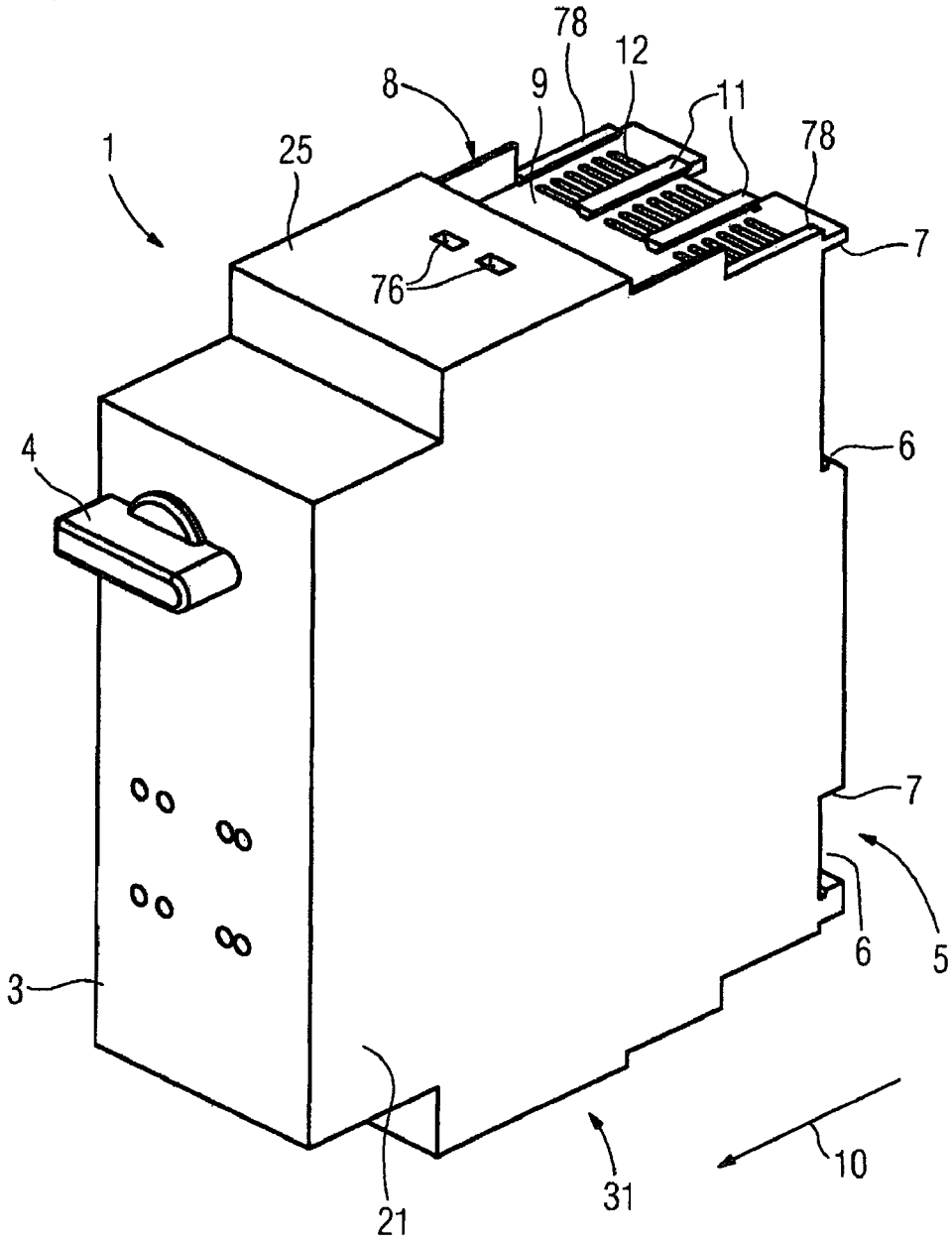
FIG. 1 shows a switching device base body without a connecting module.
Figure 2:
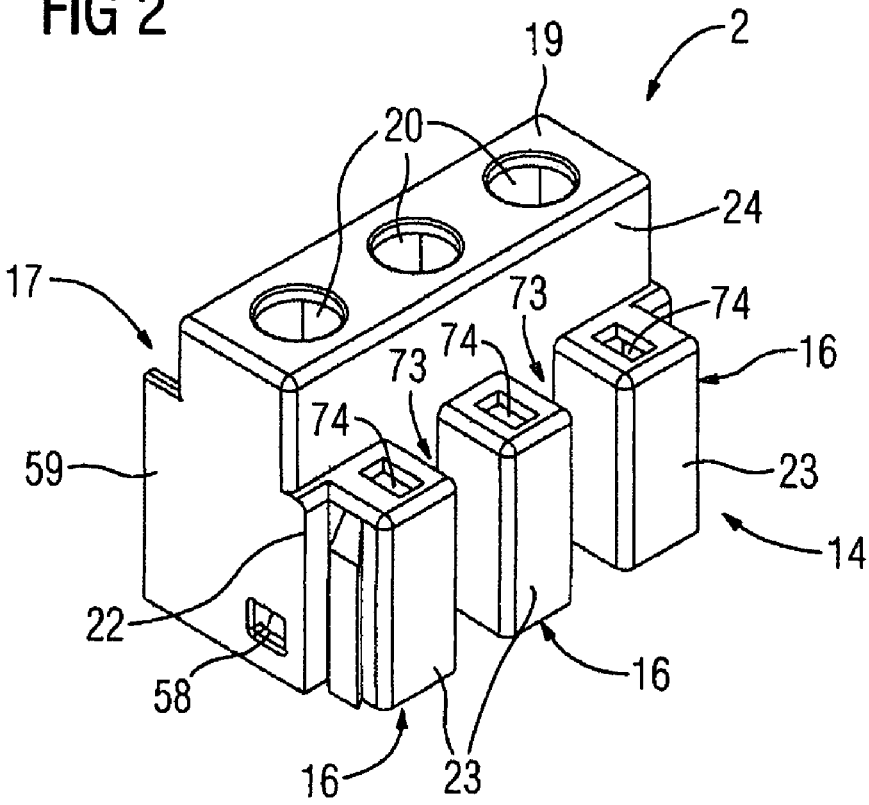
FIG. 2 shows a connecting module.
Figure 3:
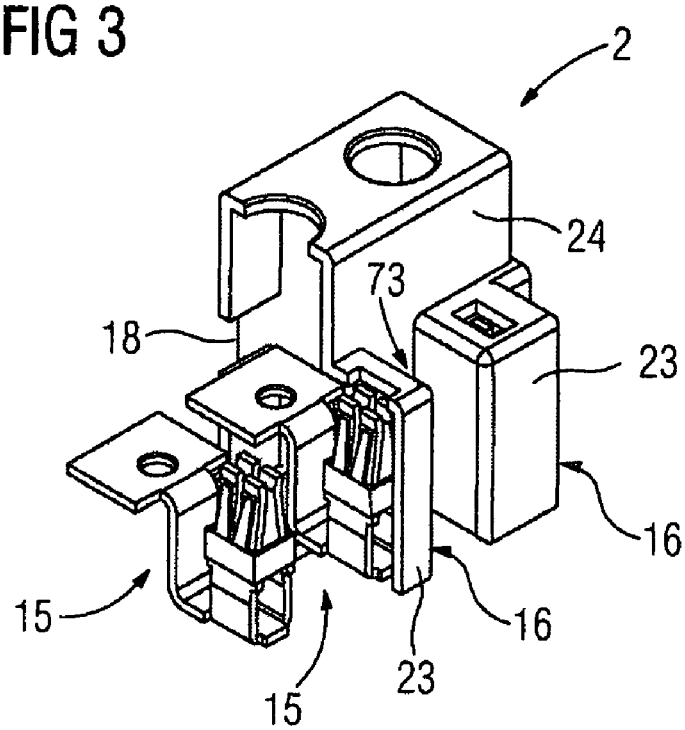
FIG. 3 shows the connecting module from FIG. 2, with the housing partially removed.
Figure 10:
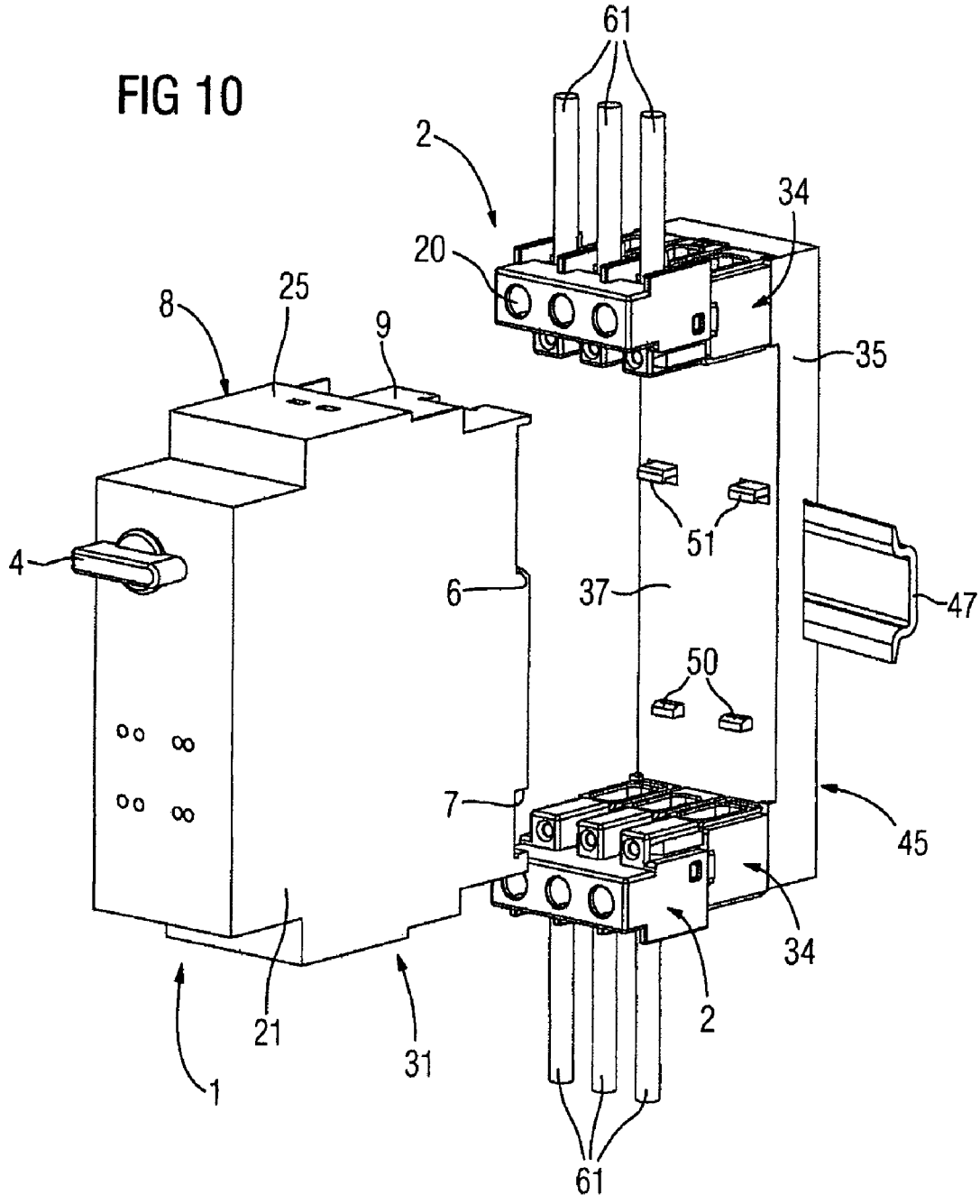

The switching device according to an embodiment of the invention in the simplest case comprises a switching device base body 1, see FIG. 1, and a connecting module 2, see FIGS. 2 and 3. On its front face 3, the switching device base body 1 has a rotary switch 4 for operating the switching device. Attachment projections in the form of two retaining grooves 6, which run transversely over the entire rear face, as well as two stop strips 7, which are used to connect the switching device base body 1 to other mounting elements, are provided on the opposite rear face 5 of the switching device base body 1, see FIG. 8 or 10. A mounting surface 9 which has been introduced and is therefore arranged in a recessed form is located on the upper face 8 of the switching device base body 1, and guide webs 11, running in the housing longitudinal direction 10 and having a trapezoidal cross section, are fitted to this mounting surface 9 in order to form dovetail connections.

A multiplicity of blow-out openings 12 for the switching chamber of the switching device base body 1 are located between the guide webs 11. Guide webs 11 and blow-out openings 12 are located in the area of the first section, facing the rear face 5 of the switching device base body 1, of the mounting surface 9, while the second section of the mounting surface 9, adjacent to this first section in the direction of the front face 3 of the switching device base body 1, has no guide webs. In addition, no blow-out openings 12 are provided in the area of this second section.

On its lower face 14, the connecting module 2 has three terminal contacts 15, which are located in housing sections 16 that are each separated from one another. Conductor insertion openings 18 are provided on the opposite upper face 17 of the connecting module 2. The front face 19 of the connecting module 1 is equipped with operating openings 20 for the terminal contacts 15.

In order to mount the connecting module 2 securely on the switching device base body 1, the terminations of the side parts 21 of the switching device base body 1 are designed to rise in a stepped form from its rear face 5 towards its front face 3, such that, in the installed state (see FIG. 6), the side contour 22 of the connecting module 2 terminates with the side parts 21 of the switching device base body 1, and the lower faces 23 of the housing sections 16 for the terminal contacts 15 rest on the second section of the mounting surface 9, while the lower face 24, which is not provided with housing sections 16, of the actual module housing rests on the upper face 25 of the switching device base body 1.

Figure 4:
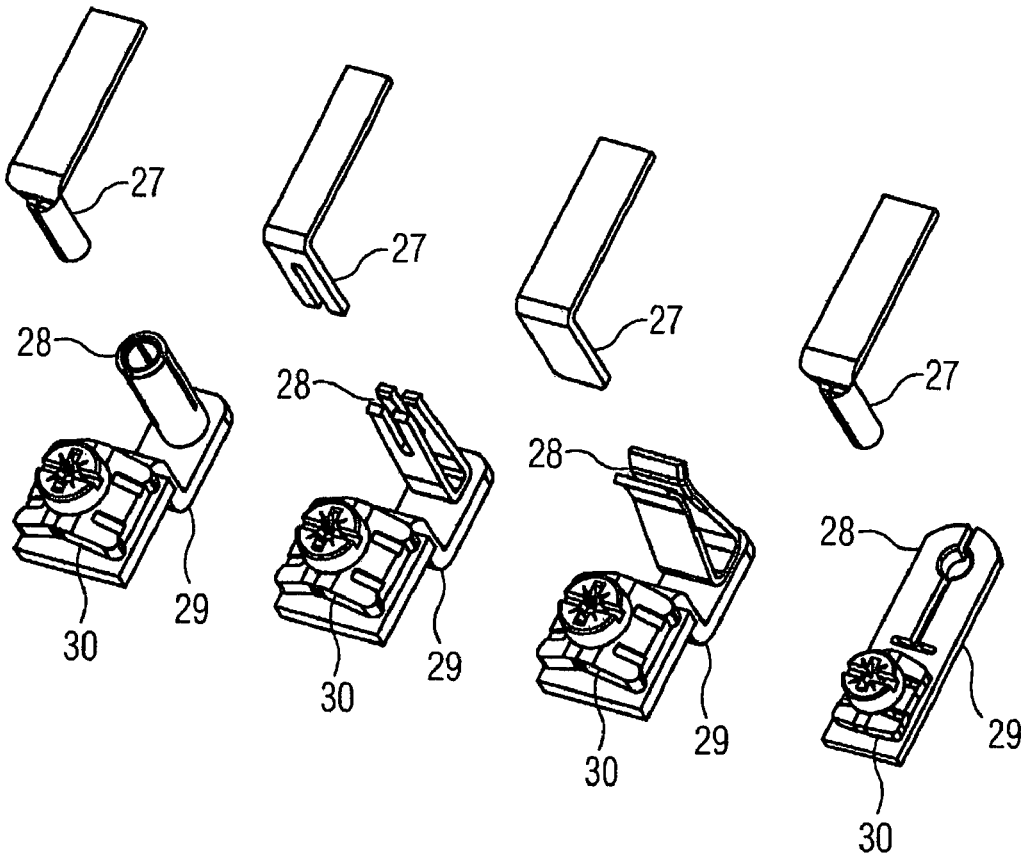
FIG. 4 shows variants of a plug contact which can be used in a connecting module.

Terminal contacts 15 are arranged in a manner known per se from the prior art in the connecting module 2, see FIG. 3. These are preferably plug contacts, various forms of which are illustrated by way of example in FIG. 4. A corresponding number of plug contact pins 27 are provided in the switching device base body 1 and extend in the direction of the rear face 5 of the switching device base body 1, running in the longitudinal direction 10 in the second section of the mounting surface 9. The plug contact sockets 28, which are complementary to the plug contact pins 27, are located in the corresponding housing sections 16 of the connecting module 2 and are connected to corresponding screw connections 30 via a contact rail 29. The screw connections 30 can be opened and closed by way of a screwdriver, which can be inserted through the operating openings 20.

On the lower face 31, which is opposite the upper face 25 of the switching device base body 1, the switching device base body 1 is designed to be identical to its upper face 25. In other words, a connecting module 2 can also be connected there.

Figure 5:
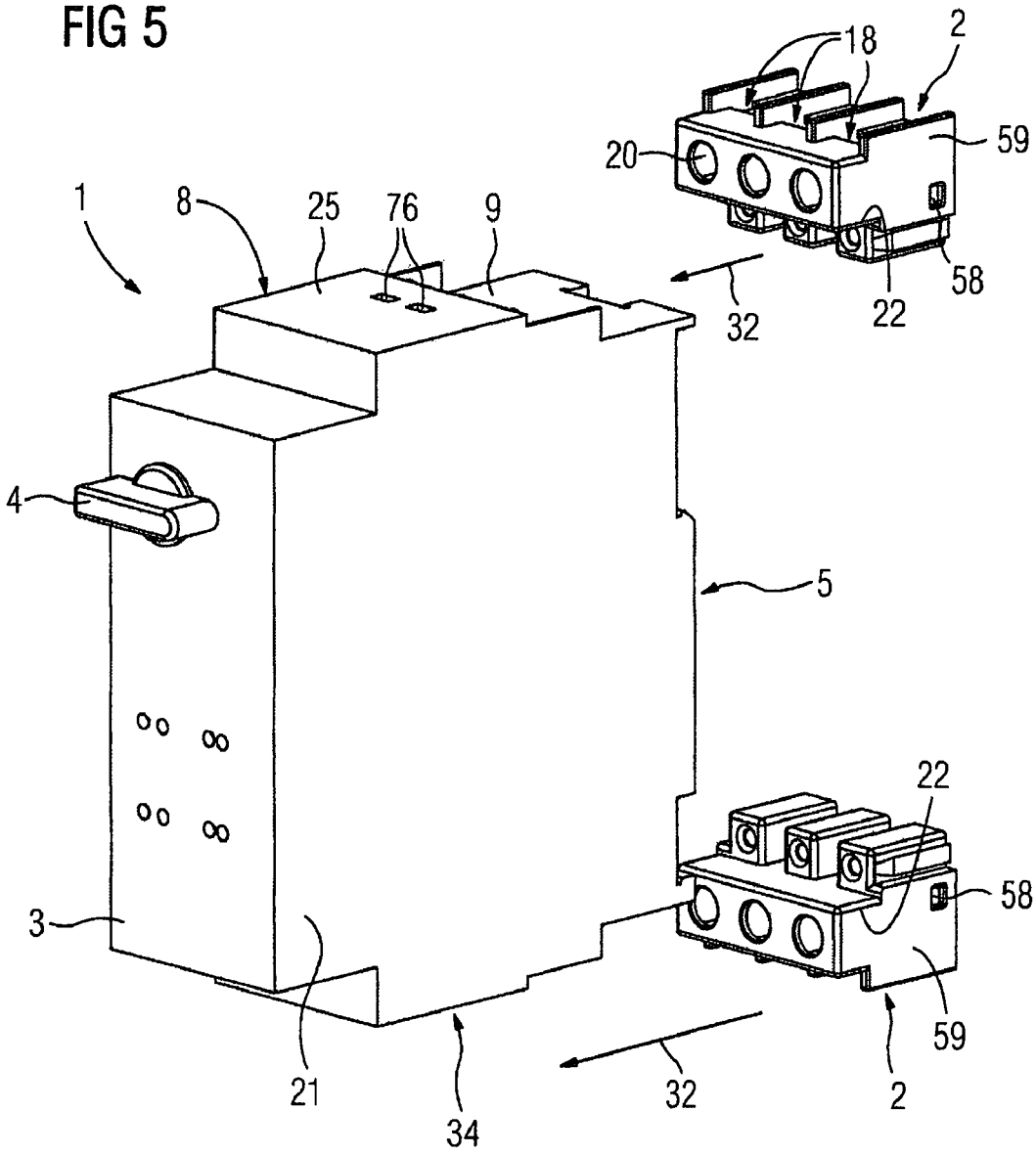
FIGS. 5 to 10 show various installation steps for a switching device arrangement with a switching device and a mounting plate.

In a first step of the process for fitting the switching device, two connecting modules 2 are mounted on the switching device base body 1, see FIG. 5. For this purpose, the connecting module 1 is simply inserted into the second section of the mounting surface 9 in the installation direction 32, parallel to the longitudinal direction 10 of the switching device base body 1. During this process, an electrical plug connection is made on the one hand between the plug contact pins 27, which project into the second section of the mounting surface 9, on the switching device base body 1, and the plug contact sockets 28 in the connecting module 2 on the other hand. At the same time, the housing sections 16 and the actual module housing of the connecting module 2 make contact with the switching device base body 1, so that the plug connection also ensures a secure mechanical connection. Furthermore, a mechanical connection is ensured between the connecting module 2 and the switching device base body 1 by way of a number of locking elements, whose operation will be explained further below.

Figure 6:
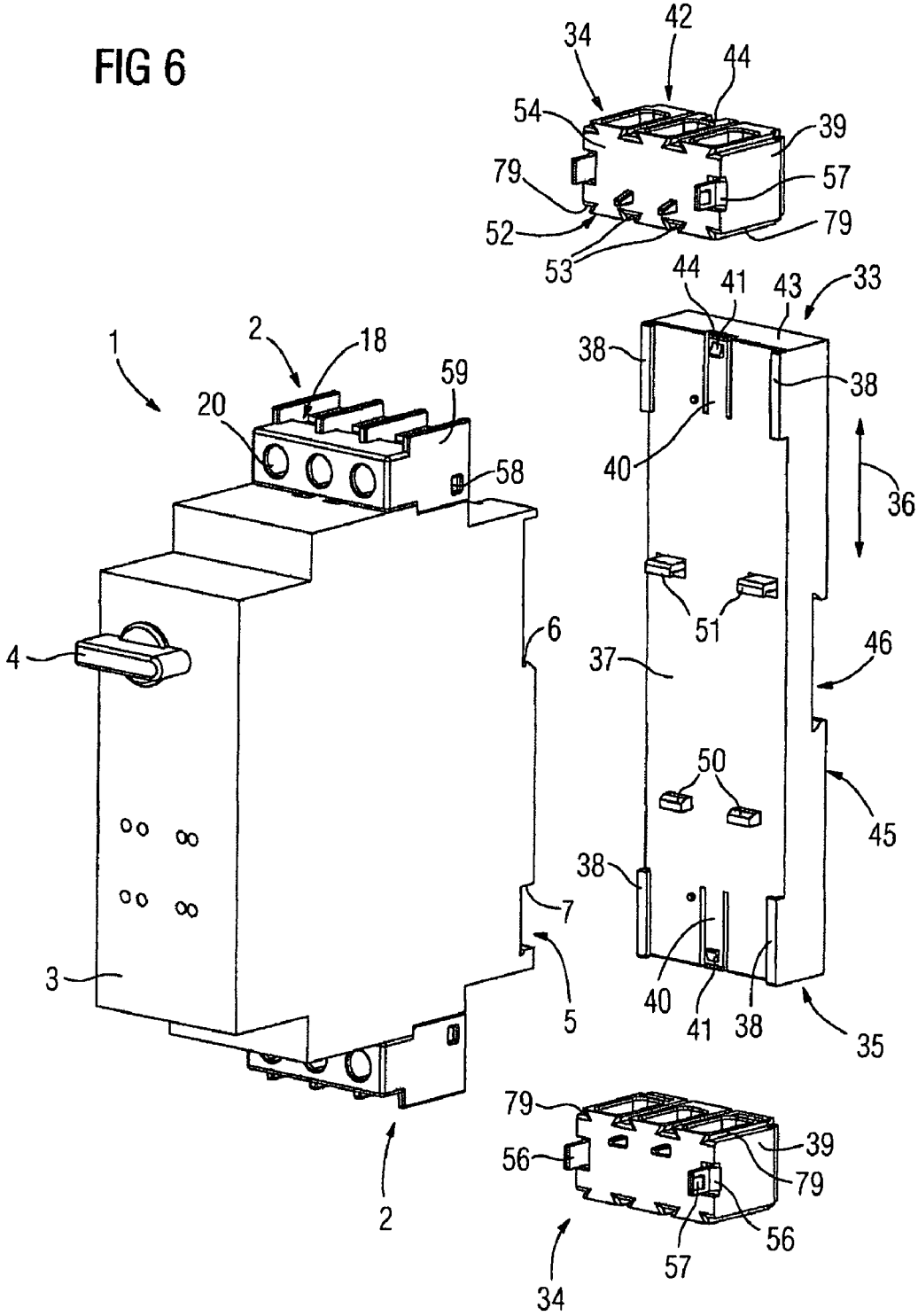
Figure 7:
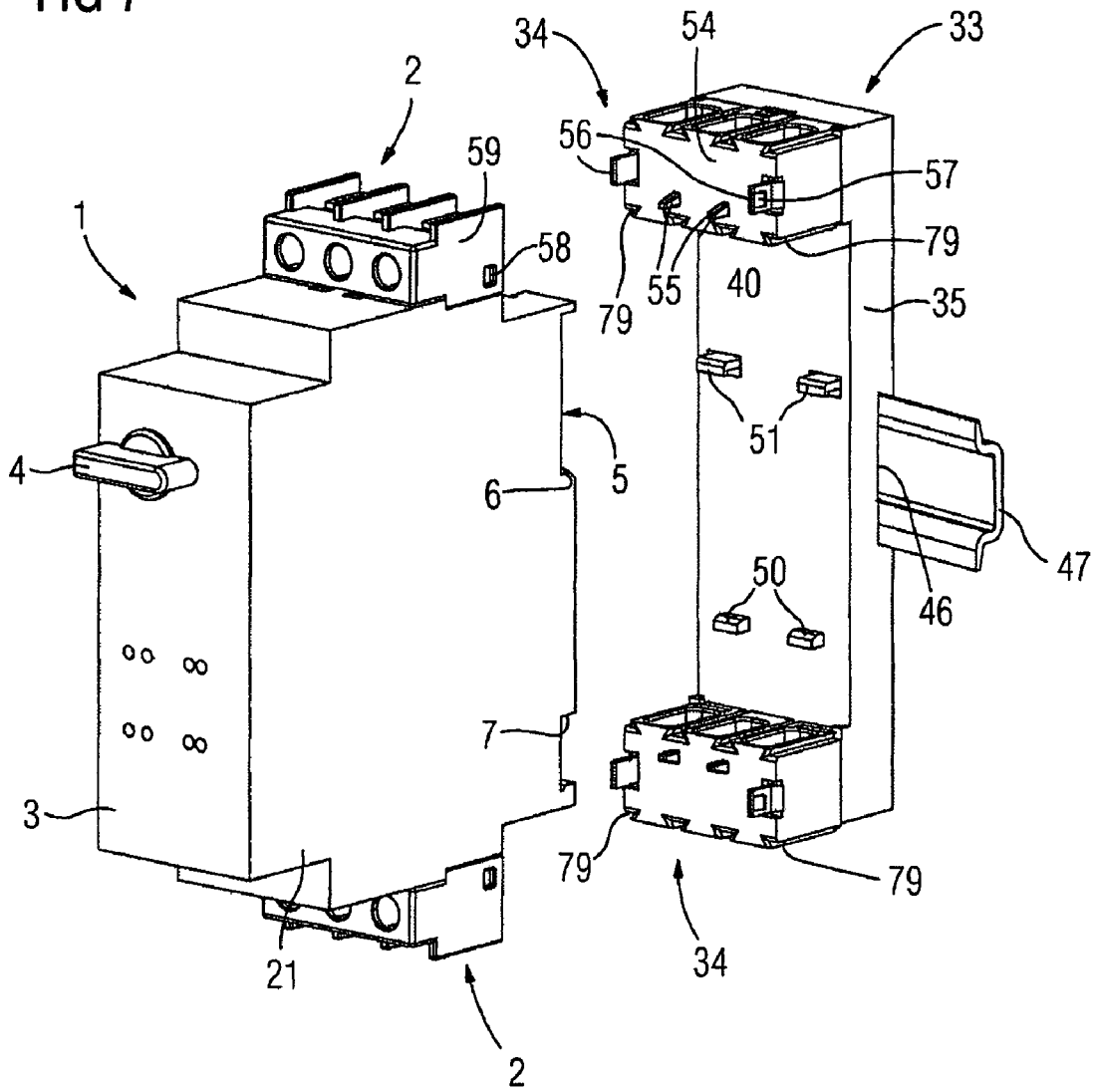

When using a mounting plate 33 to mount the switching device on a mounting rail, the mounting parts 34 are first of all mounted on a holding plate 35, as is illustrated in FIGS. 6 and 7. The mounting parts 34 are in this case pushed onto the holding plate 35 in the vertical direction 36, from above and below. For this purpose, the holding plate 35 has side guide flanks 38, which are used to guide the mounting parts 34, in the area of its upper and lower ends, on its front face 37 facing the switching device base body 1. In other words, in the installed state, the side parts 39 of the mounting parts 34 rest on the guide flanks 38.

Spring tongues 40 which are machined out of the housing material of the holding plate 35 are provided between the guide flanks 38, arranged approximately centrally on the front face 37 of the holding plate 35, at both ends of the holding plate 35, to each of whose ends pointing away from the center of the holding plate 35 a latching element 41 with an incline is fitted. When the mounting parts 34 are being mounted on the holding plate 35, the latching elements 41 latch into latching recesses (not shown) which are provided in a corresponding manner on the mounting parts 34, and thus ensure a secure connection between the mounting parts 34 and the holding plate 35. Operating openings 44 are provided on the upper faces 42 of the mounting parts 35 and on the end surfaces 43 of the holding plate 35 in order to release these connections, through which openings 44 a screwdriver or some other operating tool can be inserted in order to deflect the spring tongues 40 to their open position.

A dovetail joint groove 46 for attaching the holding plate 35 to a transverse mounting rail is incorporated on the rear face 45, opposite the front face 37 of the holding plate 35. In FIG. 7, the mounting parts 35 have already been mounted on the holding plate 35, thus resulting in a complete mounting plate 33, which is attached to a mounting rail 46.

In order to mount the switching device on the mounting plate 33, attachment elements, which are arranged in pairs above and below the rear-face dovetail groove 46, are provided on the front face 37 of the holding plate 35 and allow detachable attachment of the holding plate 35 to the corresponding mating contour 6, 7 of the rear face 5 of the switching device base body 1. One attachment element pair 50 is in this case used to support the holding plate 35 on the holding strip 7 on the switching device base body 1, while the second attachment element pair 51 is in the form of latching hooks which can be deflected in the vertical direction 36, engaging behind a corresponding mating contour 6 on the rear face 5 of the switching device base body 1 in the installed state. In this case, the end faces of the latching hooks 51 are provided with inclines such that they are deflected in the vertical direction 36 during a movement of the mating contour 6 on the rear face 5 of the switching device base body 1 onto them, and engage in the mating contour 6 on passing over the latching point.

On its lower face 52 that is used as the mounting face, the mounting part 34 has holding grooves 53, with a trapezoidal cross section, and is pushed onto the first section of the mounting surface 9 on the upper face 8 of the switching device base body 1 in the installation direction 32 such that the complementary guide webs 11, which are arranged there, engage in the holding grooves 53 in order to form an interlocking connection. At the same time, two pins 55 are located on the front face 54, facing the switching device base body 1, of the mounting part 34 and project from the front face 54, and the function of these pins 55 will be explained in detail further below.

Figure 8:
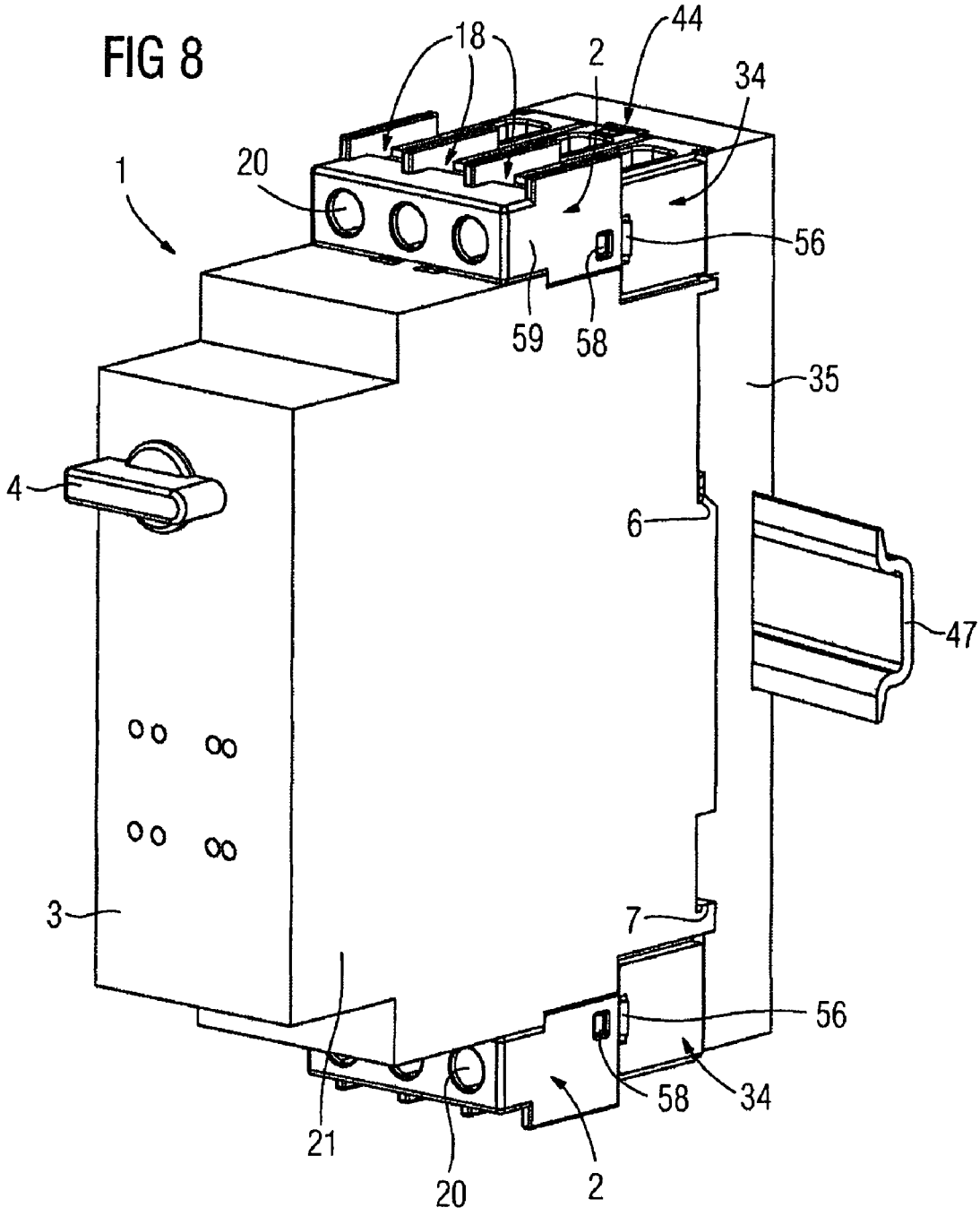
Figure 9:
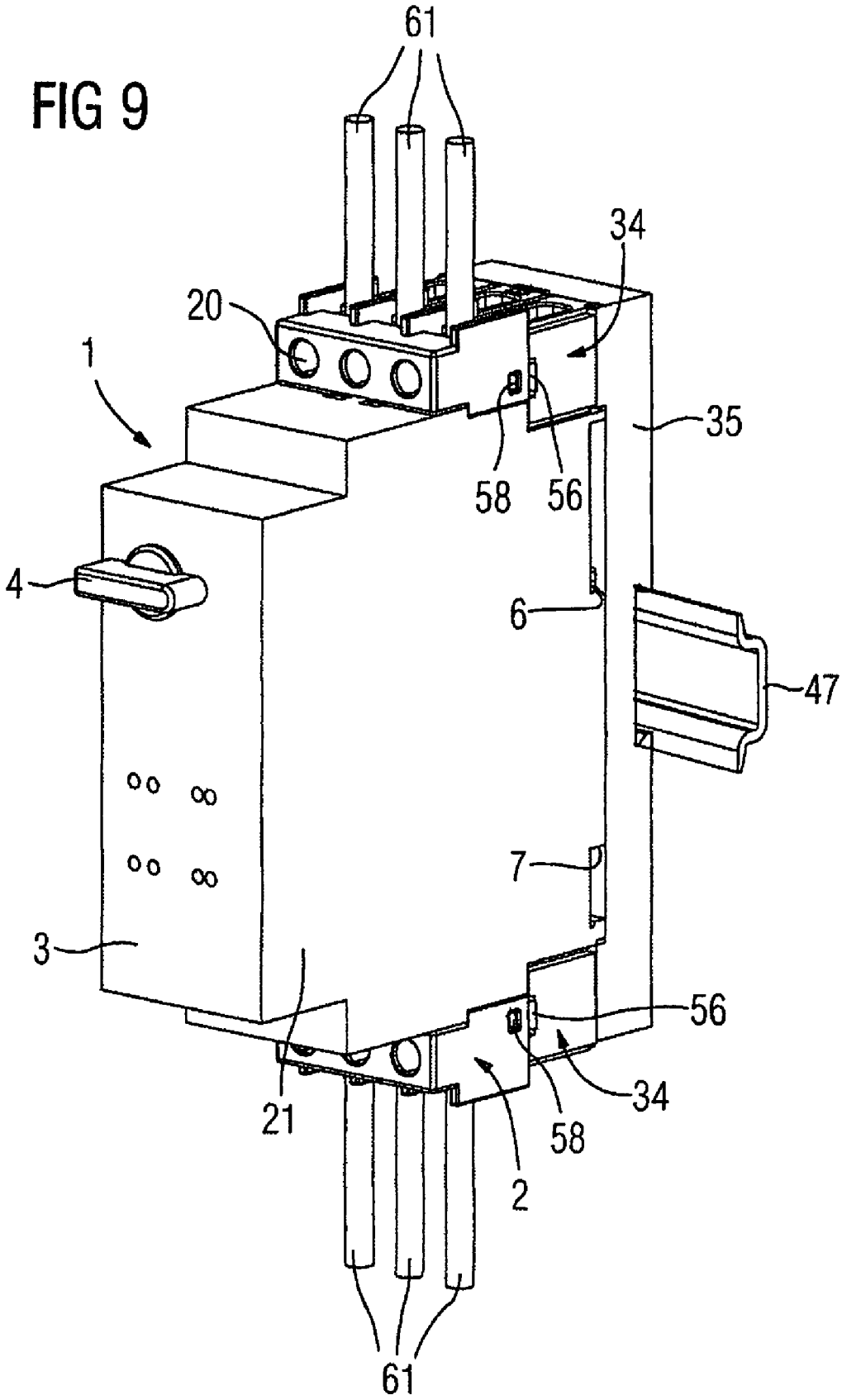

Latching elements 56 which point in the direction of the switching device, can be deflected in a sprung manner and have latching hooks 57 that point outwards are provided on the side parts 39 of the mounting part 34, with these latching hooks 57 latching into corresponding latching recesses 58 on the side parts 59 of the connecting module 2 in the installed position, see FIG. 8. The switching device arrangement which has been installed completely as shown in FIG. 8 can now be connected to the corresponding connecting lines 61 in order to form the three main current paths, as is illustrated in FIG. 9. Since, as will be explained in more detail further below, the connection between the connecting module 2 and the switching device base body 1 has been released with the connection of the mounting part 34 and connecting module 2, the switching device base body 1 can now be removed from the switching device arrangement, see FIG. 10.

The connecting modules 2 with the mounting parts 34 and the holding plate 35 remain in the installed state, and form a so-called permanent wiring. Since the connecting modules 2 can be mounted on the mounting parts 34 even without the switching device base body 1, it is possible to wire the main current paths in advance, without any switching device base body 1 being installed. By way of example, a switchgear cabinet can be completely wired in advance without a single switching device having already been connected. The switching device base body 1 can then be installed subsequently, for example by a customer.

Figure 11:
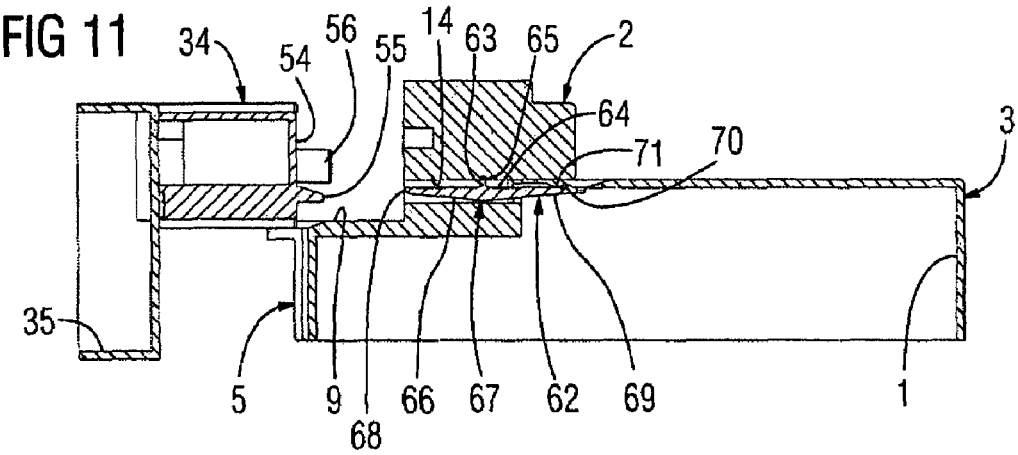
FIGS. 11 and 12 show installation steps for the switching device arrangement as shown in FIGS. 5 to 10, in the form of section illustrations.

The connection between the connecting module 2 on the one hand and the switching device base body 1 on the other hand is made using two locking elements 62, which are in the form of two-armed levers, see FIG. 11. Each locking element 62 is mounted such that it can pivot by means of a pivoting element 63 in the lower face 14 of the connecting module 2. In this case, the pivoting element 63 extends out of the essentially flat lower face 64 of the locking element 62, and is inserted in a pivoting holder 65 in the connecting module 2. The opposite upper face 66 of the locking element 62 is in the form of a rocker. In other words, the locking element 62 has a fulcrum 67 approximately centrally and approximately in the area of the pivoting element 63, where the cross section of the locking element 62 is particularly large.

The cross section of the locking element 62 tapers from this fulcrum 67 towards its two ends. This results in a two-armed lever, with one lever arm 68 pointing in the direction of the rear face 5 of the switching device base body 1, while the lever arm 69, which points in the opposite direction, has a locking catch 70 which projects out of its lower face 64 and, in the locked position (see FIG. 11) rests on a latching projection 71, which extends from the lower face 14 of the connecting module 2 in the direction of the front face 3 of the switching device base body 1. The latching projection 71 is not shown in FIGS. 2 and 3.

The two locking elements 62 for connecting the connecting module 2 and the switching device base body 1 are arranged in the channel-like free sections 73 of the housing sections 16 for the terminal contacts 15 (see FIGS. 2 and 3). During installation, the latching hook 70 "latches" with the latching projection 71 in such a way that it is impossible to "pull" the switching device base body 1 off the connecting module 2 in the installation direction 32, see FIG. 11. At the same time, the plug contact pins 27 are inserted into the holding openings 74 which are provided for this purpose in the housing sections 16, and make contact with the plug contact sockets 28.

Figure 12:
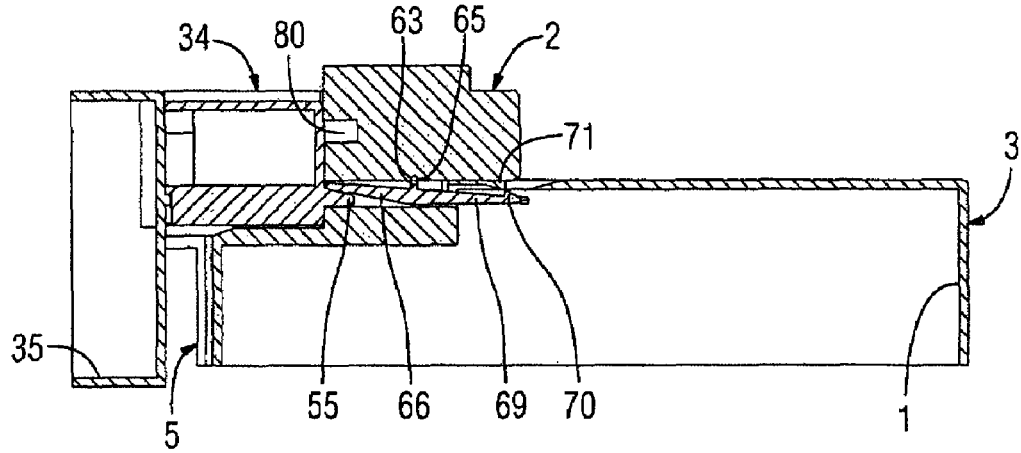

When the mounting part 34, which is attached to the holding plate 35, is being mounted on the switching device, the pins 55 which are arranged on the front face 54 of the mounting part 34 slide into the free sections 73 between the housing sections 16, and act on the locking element 62, see FIG. 12. In this case, the pins 55 are provided with an incline such that, during insertion, the lever arm 66, which points in the direction of the rear wall 5 of the switching device base body 1, is pressed down by the pin 55 in the direction of the connecting module 2. The locking catch 70 on the opposite lever arm 69 is forced out by the lever function, and is moved to its open position. At the same time, the connection is produced between the mounting part 34 and the connecting module 2 via the side latching elements 56, 58. In other words, the connecting module 2 is permanently connected to the mounting part 34 while the switching device base body 1 can be removed from the mounting plate 33 and from the connecting module 2 attached to it, in the installation direction 32.

The mounting parts 34 also have holding grooves 53 on their upper face 42, so that it is also possible to push the mounting parts 34 onto the guide webs 11 of the switching device base body rotated through 180° (not shown). In this case, the pins 55 engage in empty openings 80, which are provided for this purpose on the connecting module 2. This makes it possible for one and the same mounting part 43 to be used for mounting both with and without opening of the connection between the connecting module 2 and the switching device base body 1.

Figure 13:
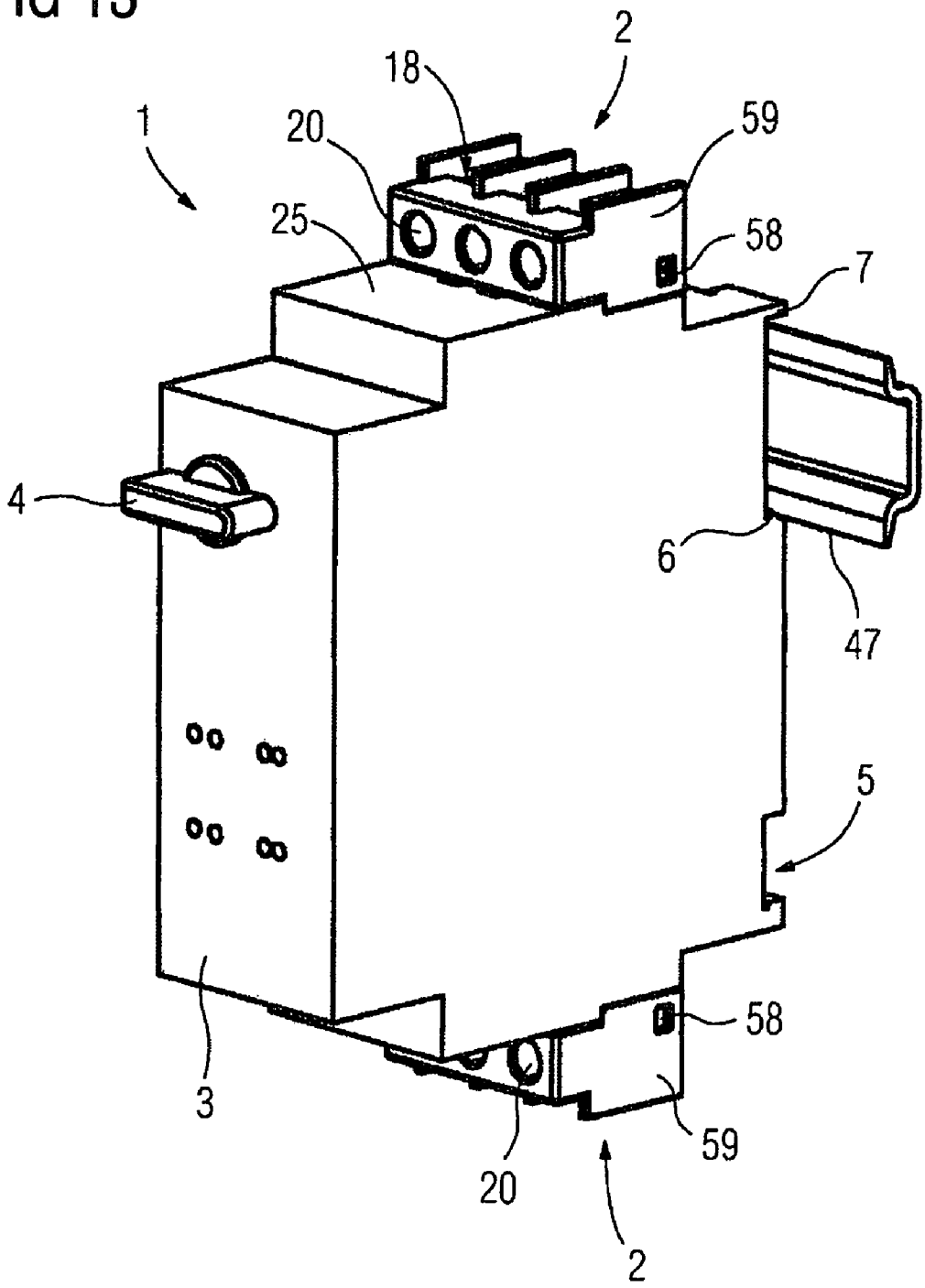
FIGS. 13 to 15 show various installation steps for a switching device, for direct mounting on a mounting rail.

If the intention is to use the switching device according to the invention without a mounting plate 33, the switching device can be attached directly to a mounting rail 47, as shown in FIG. 13. In this case, the holding groove 6 of the rear face 5 of the switching device base body 1, and the guide strip 7 which is formed by the first section of the mounting surface 9 projecting beyond the rear face 5 of the switching device base body 1, provide a corresponding holding contour for the mounting rail 47.

Figure 16:
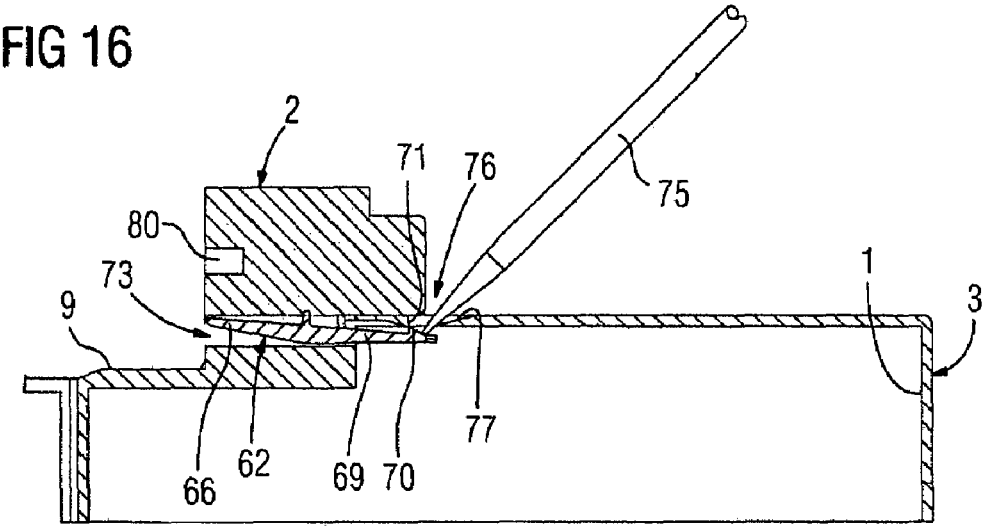
FIG. 16 shows a switching device arrangement as shown in FIGS. 13 to 15, in the form of a section illustration.
Figure 14:
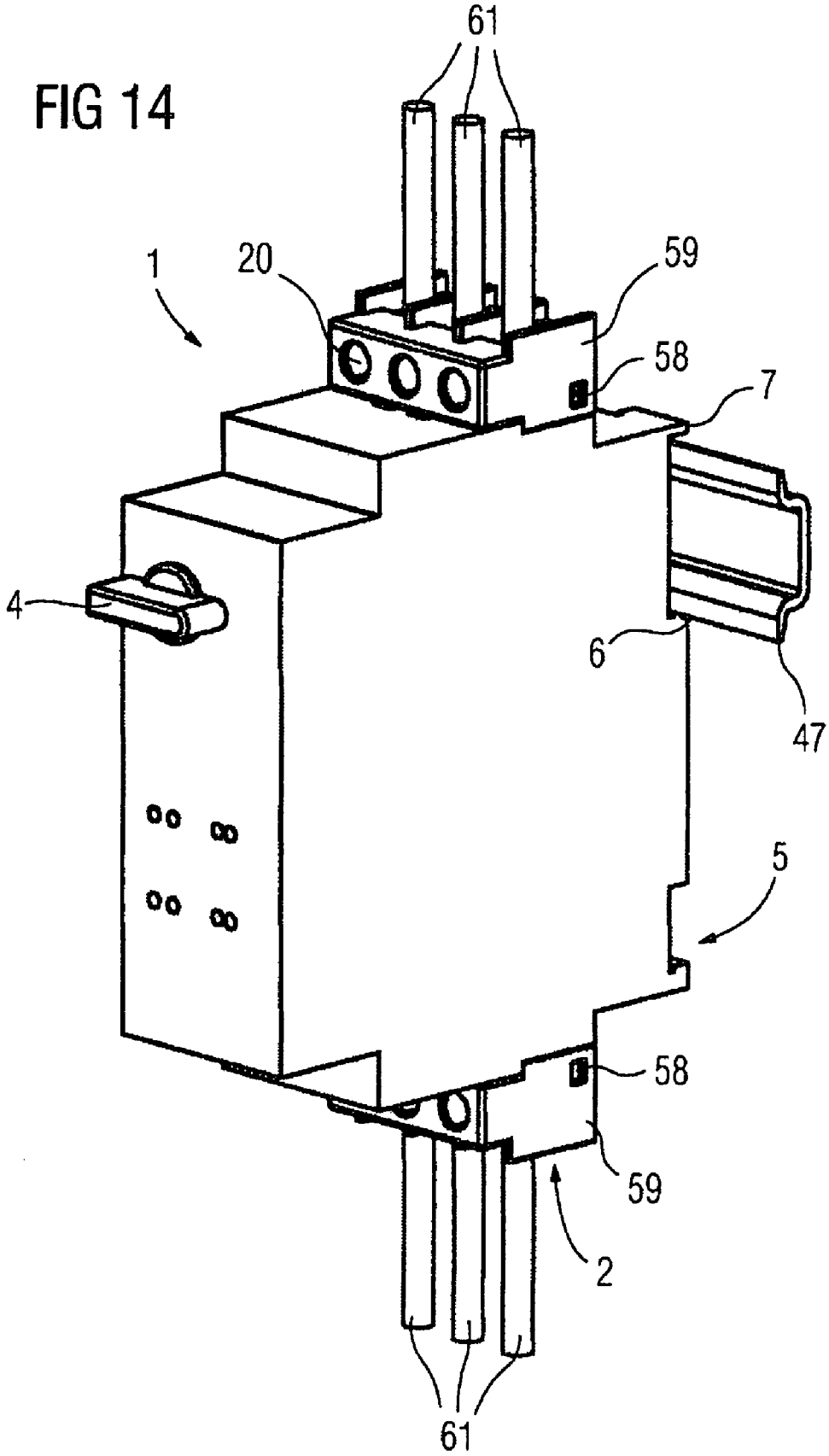
Figure 15:
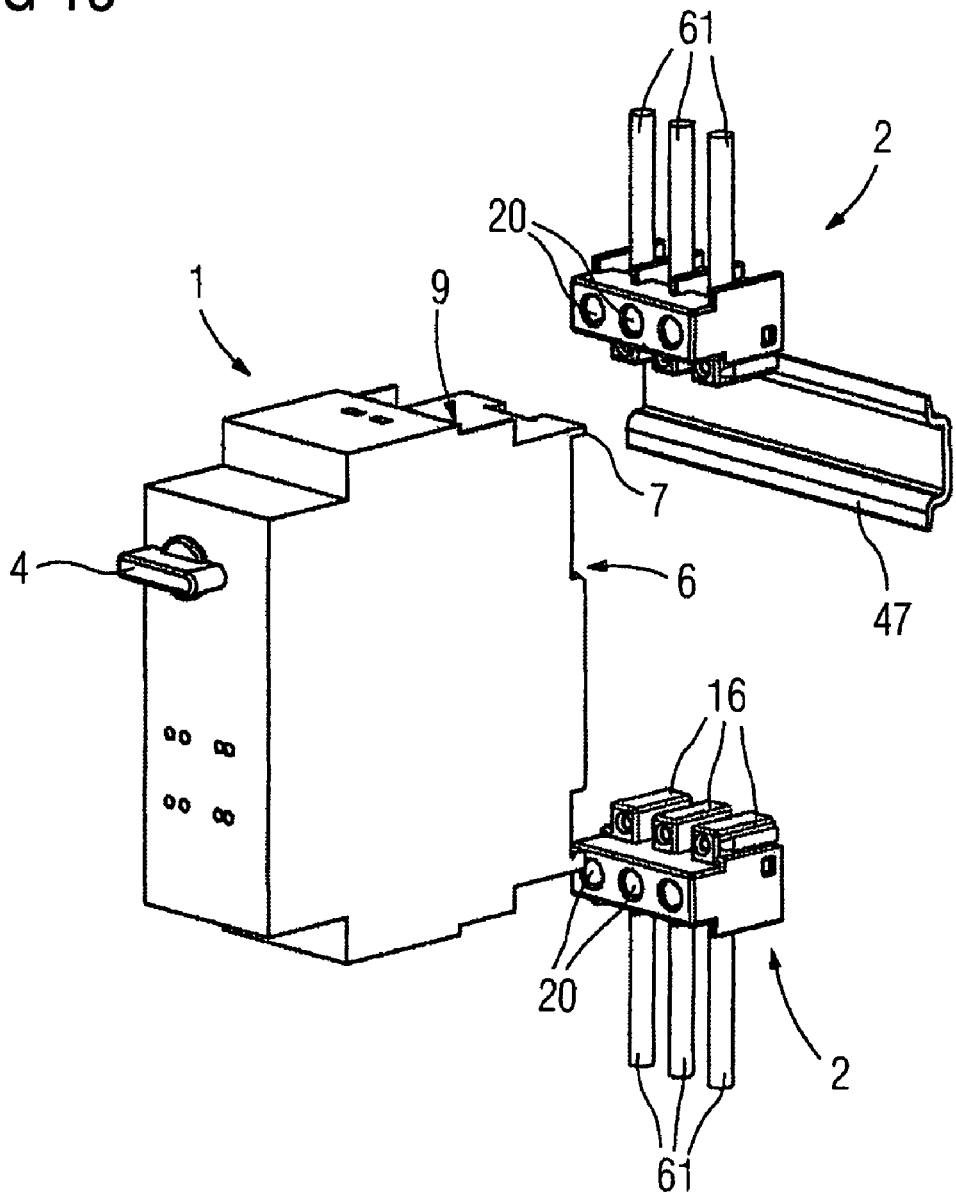

When the connecting modules 2 are connected to the corresponding connecting lines 62 (see FIG. 14), then the switching device base body 1 can be replaced easily and quickly, as in the case of the first exemplary embodiment as well. In this case, all that is necessary is to release the plug contacts and to pull the switching device base body 1 off the mounting rail 47, see FIG. 15. In this case, the locking element 62 can be forced out of its locked position even without a mounting part, specifically with the aid of an operating tool 75, see FIG. 16.

For this purpose, an operating opening 76 is provided for each locking element 62 on the upper face 8 of the switching device base body 1, through which opening 76 an operating tool 75, for example a screwdriver or the like, can be inserted. The tip of the operating tool 75 is in this case guided directly to the lever arm 69 to be operated, by means of the incline 77 on the operating opening 76, so that the lever is forced out just by pushing it.

Since in this example embodiment as well, the connecting modules 2 can be released from the switching device base body 1, it is also possible in this case to replace the switching device base body 1 without having to remove the connecting lines 61. One particularly advantageous feature of the position of the locking element 62 is that the connection can be released from the front, that is to say from the front face 3 of the switching device base body 1.

Each of the figures shows only a single switching device or a single switching device arrangement. It is, of course, also possible to arrange a plurality of switching devices alongside one another in the form of an installation assembly. For this purpose, two side guide webs 78, which are bisected in the longitudinal direction 10, are provided alongside the two central guide webs 11 on the mounting surface 9 of the switching device base body 1. Corresponding side guide grooves 79 with a "bisected cross section" are provided on the lower face 52 of the mounting parts 34. The web halves which are required for filling the guide grooves 79 are complemented by the side guide webs that are likewise provided there, during installation of an adjacent switching device base body (not shown).

It is within the scope of the invention to provide only the feed side or the outgoer side of the switching device with a connecting module according to embodiments of the invention, with the other side in each case being connected in the conventional manner.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electromechanical switching device, comprising:

a switching device base body; and a connecting module, connectable to the switching device base body, including at least one connecting terminal for a main current path of the switching device, and including at least one locking element for mechanical connection of the connecting module and the switching device base body, the at least one locking element being is designed such that the connection of the connecting module and switching device base body is released when a connection is made between the connecting module and a mounting plate for mounting the switching device on a mounting rail.

2. The electromechanical switching device as claimed in claim 1, wherein the switching device base body and the connecting module are detachably connected to one another.

3. The electromechanical switching device as claimed in claim 1, further comprising an electrical plug connection between the connecting module and the switching device base body.

4. The electromechanical switching device as claimed in claim 1, wherein the locking element is used to form a lever lock such that operation of the lever releases the connection between the connecting module and the switching device base body.

5. The electromechanical switching device as claimed in claim 4, wherein the locking element includes a locking catch on one of its levers, the locking catch, when in the locked position, resting on a latching projection arranged on at least one of the connecting module and the switching device base body.

6. The electromechanical switching device as claimed in claim 1, wherein the switching device base body is designed for direct mounting on a mounting rail.

7. A switching device arrangement, comprising:

an electromechanical switching device as claimed in claim 1, and a mounting plate to mount the switching device on a mounting rail.

8. The switching device arrangement as claimed in claim 7, wherein the mounting plate includes a holding plate and a mounting part, detachably connected to the holding plate.

9. The switching device arrangement as claimed in claim 8, wherein the mounting part includes connection elements to form a detachable mechanical connection to the connecting module.

10. The switching device arrangement as claimed in claim 9, wherein the connection between the connecting module and the switching device base body is released when the mounting part and the connecting module are connected to one another.

11. The switching device arrangement as claimed in claim 8, wherein the connection between the connecting module and the switching device base body is released when the mounting part and the connecting module are connected to one another.

12. The switching device arrangement as claimed in claim 8, wherein the mounting part includes at least one operating element, the operating element operating the locking element during production of a connection to the connecting module.

13. The switching device arrangement as claimed in claim 7, wherein the holding plate includes connection elements to form a detachable mechanical connection to the switching device base body.

14. An electrical connecting module, comprising:

at least one connecting terminal for a main current path of an electromechanical switching device, the connecting module being mechanically connectable to a base body of the switching device with the aid of at least one locking element, the locking element being designed such that the connection of the connecting module and switching device base body is released when a connection is made between the connecting module and a mounting plate to mount the switching device on a mounting rail.

15. A switching device arrangement, comprising:

an electromechanical switching device as claimed in claim 1, and means for mounting the switching device on a mounting rail.

16. The switching device arrangement as claimed in claim 15, wherein the means for mounting includes a holding plate and a mounting part, detachably connected to the holding plate.

17. The switching device arrangement as claimed in claim 16, wherein the mounting part includes means for forming a detachable mechanical connection to the connecting module.

18. The switching device arrangement as claimed in claim 17, wherein the connection between the connecting module and the switching device base body is released when the mounting part and the connecting module are connected to one another.

19. The switching device arrangement as claimed in claim 15, wherein the holding plate includes means for forming a detachable mechanical connection to the switching device base body.

* * * * *